US009194198B2

(12) United States Patent
Ramon

(10) Patent No.: US 9,194,198 B2
(45) Date of Patent: Nov. 24, 2015

(54) RUNNABLE MEMBER CATCHER, SYSTEM AND METHOD OF REMOVING SAME

(71) Applicant: Michael Ramon, Houston, TX (US)

(72) Inventor: Michael Ramon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 282 days.

(21) Appl. No.: 13/764,114

(22) Filed: Feb. 11, 2013

(65) Prior Publication Data

US 2014/0224505 A1 Aug. 14, 2014

(51) Int. Cl.

| | |
|---|---|
| ***E21B 23/01*** | (2006.01) |
| ***E21B 33/16*** | (2006.01) |
| *E21B 33/14* | (2006.01) |

(52) U.S. Cl.

CPC ..... *E21B 23/01* (2013.01); *E21B 33/16* (2013.01); *E21B 33/14* (2013.01)

(58) Field of Classification Search

CPC ..... E21B 33/16; E21B 23/08; E21B 23/02; E21B 33/134; E21B 33/14; E21B 23/01

See application file for complete search history.

(56) References Cited

U.S. PATENT DOCUMENTS

| | | | | |
|---|---|---|---|---|
| 3,638,730 | A * | 2/1972 | Smith | 166/291 |
| 5,437,330 | A | 8/1995 | Gambertoglio | |
| 6,457,517 | B1 | 10/2002 | Goodson et al. | |
| 2010/0270031 | A1 | 10/2010 | Patel | |
| 2011/0135953 | A1 * | 6/2011 | Xu et al. | 428/548 |
| 2012/0292053 | A1 | 11/2012 | Xu et al. | |
| 2012/0318513 | A1 | 12/2012 | Mazyar et al. | |

OTHER PUBLICATIONS

D.G. Calvert, et al., "Improved Cementing Operations: A Field Study"; Society of Petroleum Engineers; Conference Paper SPE 23987; 1992 SPE Permian Basin Oil and Gas Recovery Conference, Mar. 18-21, 1992; pp. 443-452.

Hank Rogers, et al., "Tailpipe Disconnects Ideal for Setting Cement Plugs in Complex Wellbores; Procedures and Case Histories Provided"; Society of Petroleum Engineers; Conference Paper SPE 154632; SPE Oil and Gas India Conference and Exhibition, Mar. 28-30, 2012; pp. 1-13.

Notification of Transmittal of the International Search Report and the Written Opinion of the International Searching Authority, or the Declaration; PCT/US2014/010855; May 1, 2014; 13 pages.

* cited by examiner

*Primary Examiner* — Brad Harcourt

(74) *Attorney, Agent, or Firm* — Cantor Colburn LLP

(57) ABSTRACT

A runnable member catcher includes a body fixedly attachable within a tubular, the body defines inner radial dimensions that are smaller than portions of the body that are fixedly attached the body to the tubular, the body is configured to be structurally weakened upon exposure to an activation fluid to facilitate removal of the body.

11 Claims, 2 Drawing Sheets

RUNNABLE MEMBER CATCHER, SYSTEM AND METHOD OF REMOVING SAME

BACKGROUND

The cementing of a liner or a casing in a well is done to, among other things; prevent flow in an annular space between the liner or casing and the open borehole. It is common to perform several cementing operations within a single deep well. When additional drilling is required after a cementing operation has been completed in one section of the well, the cementing wiper plugs, landing collar and cement located at the bottom of the section of the well just cemented need to be drilled through before the drill bit can begin drilling into the earth formation again. Drilling through a landing collar can damage or dull a drill bit, can generate undesirable debris within the wellbore, and can delay drilling progress in the earth formation. Systems and methods that alleviate the foregoing concerns are well received in the industry.

BRIEF DESCRIPTION

Disclosed herein is a runnable member catcher. The catcher includes a body fixedly attachable within a tubular, the body defines inner radial dimensions that are smaller than portions of the body that are fixedly attached the body to the tubular, the body is configured to be structurally weakened upon exposure to an activation fluid to facilitate removal of the body.

Further disclosed herein is a method of removing a runnable member catcher. The method includes, exposing the runnable member catcher to an activation fluid, weakening the runnable member catcher with the activation fluid and drilling or milling out the runnable member catcher.

Further disclosed herein is a runnable member catching system. The system includes a tubular and a body fixedly attachable within the tubular and defining a seat sealingly engagable with a member runnable thereagainst, the body is configured to be structurally weakened upon exposure to an activation fluid to facilitate removal of the body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
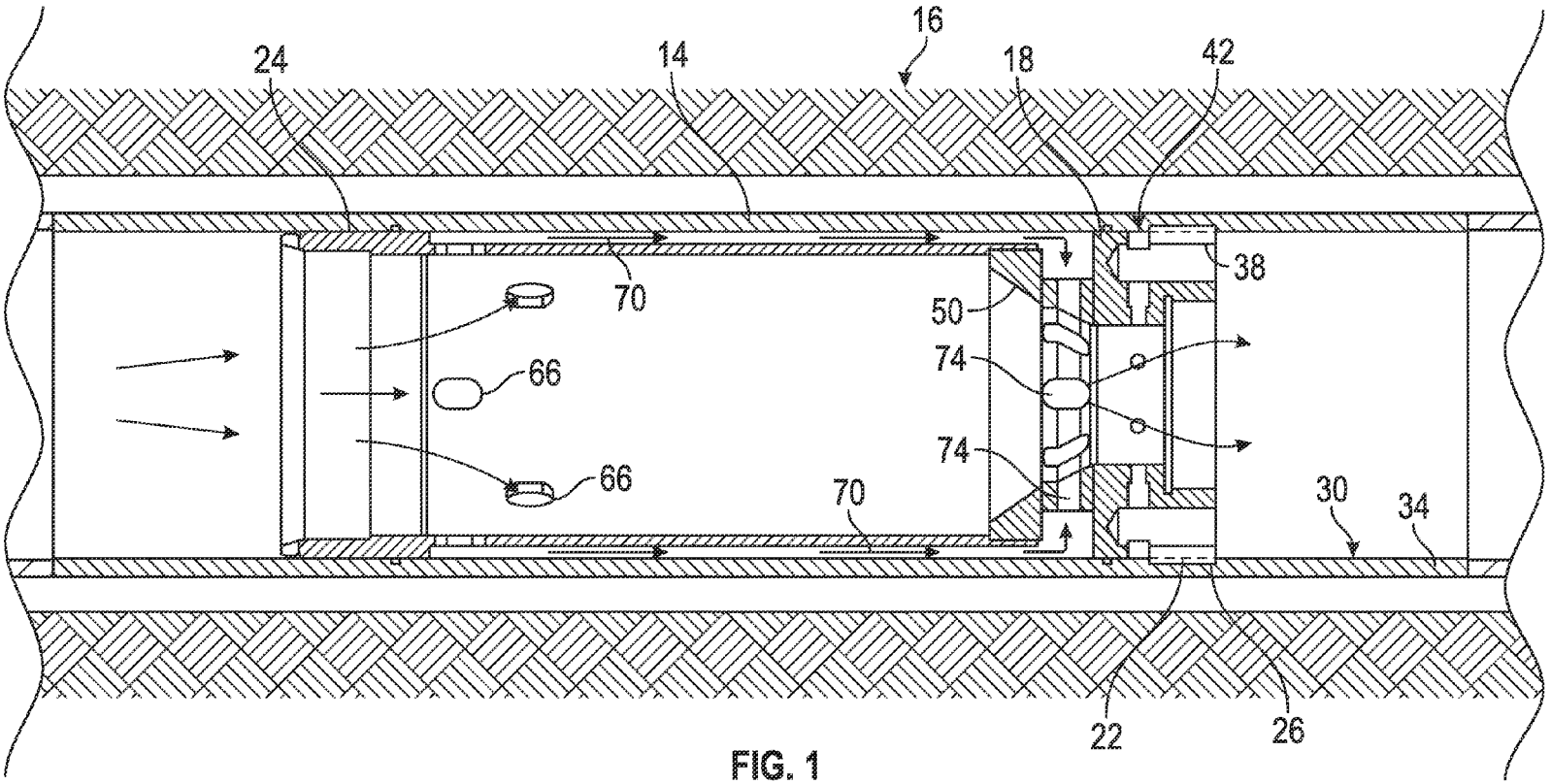
FIG. 1 depicts a cross sectional view of a runnable member catching system disclosed herein.
Figure 2:
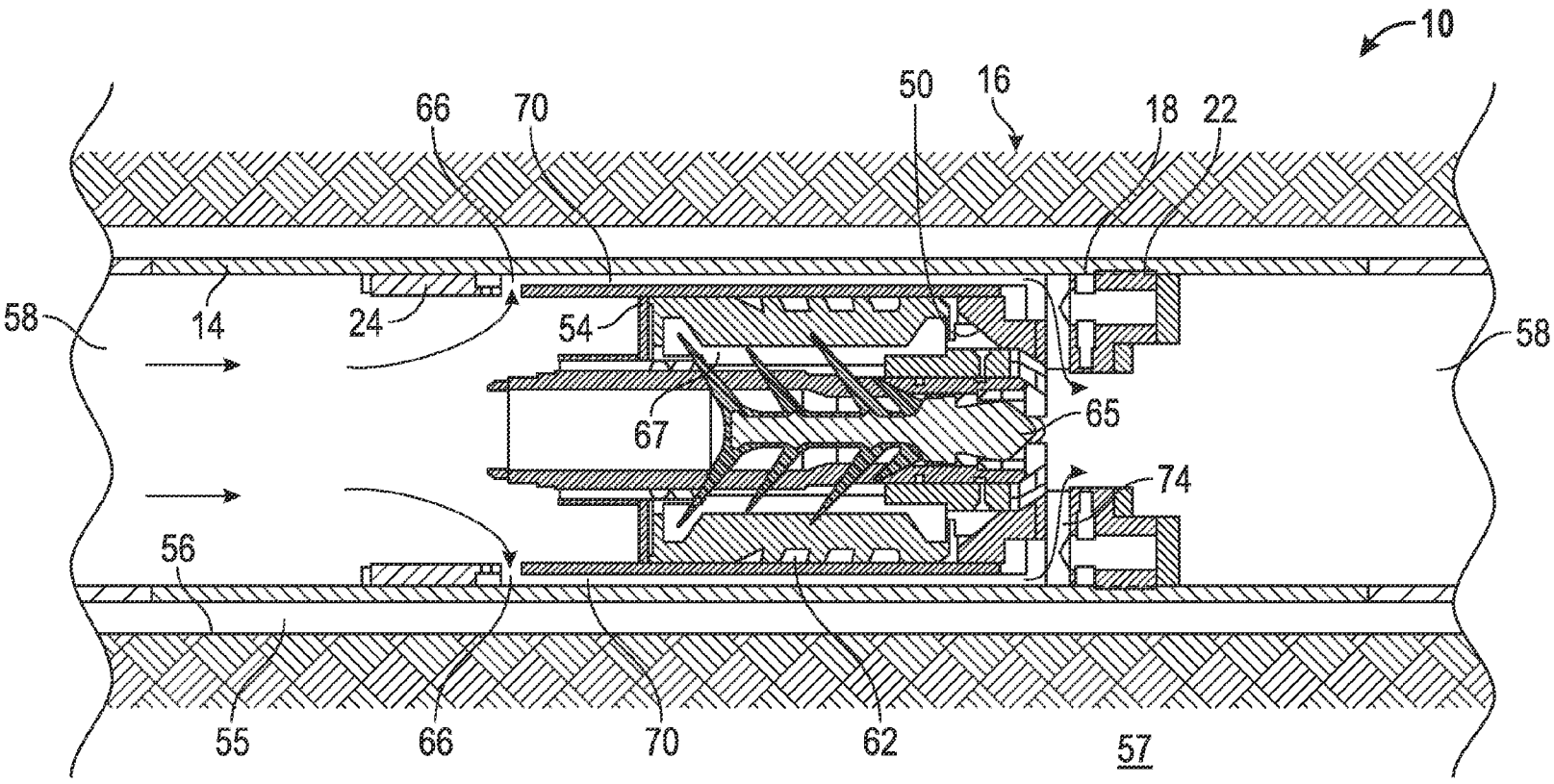
FIG. 2 depicts a cross sectional view of the runnable member catching system of FIG. 1 with a runnable member engaged therewith.

Referring to FIGS. 1 and 2 an embodiment of a runnable member catching system disclosed herein is illustrated at 10. The system includes a tubular 14 and a catcher 16 comprising in this embodiment of a body 18, an insert 22 and a sleeve 24, although in some embodiments the catcher 16 may be comprised of fewer parts such as the body 18 only, for example, which alternatively could have a tubular shape. The body 18 is fixedly attached to the tubular 14 by the insert 22. The insert 22 may be a split ring, as shown herein, that engages in a recess 26 in an inner surface 30 of walls 34 of the tubular 14 and a recess 38 in an outer surface 42 of the body 18. Alternately, the insert 22 may be engaged with one or both of the body 18 and the tubular 14 by other means such as threadable engagement, for example. The sleeve 24 is fixedly attached to the body 18 and is sealably engaged within the tubular 14. The body 18 has a seat 50 that has a smaller radial dimension than that of the tubular 14, and is sealingly engagable by a runnable member 54 shown in FIG. 2 as a wiper plug. The body 18 and optionally, the sleeve 24 and the insert 22 are made of a material that is structurally weakened in response to being exposed to an activation fluid. This weakening allows for easier removal of the body 18, the sleeve 24 and the insert 22 by processes such as drilling or milling, for example.

In one embodiment of the system 10, the body 18, the insert 22 and the sleeve 24 are manufactured from a high strength controlled electrolytic metallic material and are degradable when exposed to an activation fluid such as brine, acid, aqueous fluid or combinations of one or more of these. For example, a variety of suitable materials and their methods of manufacture are described in United States Patent Publication No. 2011/0135953 (Xu et al.), the entire Patent Publication of which is hereby incorporated by reference in its entirety.

The runnable member catching system 10 is employable in applications to allow the runnable member 54 to be caught at a known location within the tubular 14 where the catcher 16 is positioned. An example of such an application is during a downhole cementing operation wherein cement is pumped down through the tubular 14 and back up in an annular space 55 defined between the tubular 14 and an open borehole 56 in an earth formation 57. Such an operation includes using the runnable member 54 to separate cement 58 from another fluid such as by leading introduction of the cement 58 or following the conclusion of the cement 58. The runnable member 54 being a wiper plug that includes a seal 62 that sealingly engages with the inner surface 30 of the walls 34 while being run therethrough, thereby separates the cement 54 from fluid on an opposing side of the wiper plug 54 therefrom. A second wiper plug 65 is configured to slidingly sealingly engage with a smaller tubular (not shown) possible located upstream of the tubular 14. The second wiper plug 65 being also configured to sealingly engage with a bore 67 in the wiper plug 54. In FIG. 2 the wiper plug 54 is shown in a position after having been caught by the body 18, also known in this application as a landing collar, and is sealingly engaged at the seat 50. The seal 62 is engaged with the inside of the sleeve 24 and has moved downstream beyond ports 66 in the sleeve 24. Fluid is then able to flow around the wiper plug 54 by flowing through the ports 66 and through an annular space 70 defined between the sleeve 24 and the tubular 14, then through openings 74 in the body 18. In this manner the cement 58 is able to be pumped past the wiper plug 54 and the runnable member catching system 10. Another wiper plug (not shown) may then follow the cement 58 until it abuts with the wiper plug 54 thereby halting any additional flow of the cement 58.

In some embodiments the activation fluid may be electrically conductive thereby helping to establish an electrochemical reaction to facilitate degradation of the catcher 16 components. In some applications the activation fluid can be pumped to the catcher 16 and can even be the fluid separated from the cement 58 by the runnable member 54.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A runnable member catcher comprising;

a body fixedly attachable within a tubular, the body defining inner radial dimensions smaller than portions of the body that fixedly attach the body to the tubular, the body being configured to be structurally weakened upon exposure to an activation fluid to facilitate removal of the body; and an insert in operable communication with the body configured to fixedly attach the body to a tubular, the insert being configured to be structurally weakened upon exposure to an activation fluid to faciliate removal of the insert.

2. The runnable member catcher of claim 1, wherein the body defines a seat sealably engagable by a runnable member run thereagainst.

3. A runnable member catcher comprising a body fixedly attachable within a tubular, the body defining inner radial dimensions smaller than portions of the body that fixedly attach the body to the tubular, the body being configured to be structurally weakened upon exposure to an activation fluid to facilitate removal of the body, the body including openings to allow flow to pass the body while the body remains fixed within the tubular and sealably engaged with a runnable member.

4. The runnable member catcher of claim 1, further comprising a sleeve in operable communication with the body defining an annular flow path with a tubular that the body is attachable to, the sleeve being configured to be structurally weakened upon exposure to an activation fluid to facilitate removal of the sleeve.

5. The runnable member catcher of claim 1, wherein the body is made of a corrodible or dissolvable material.

6. The runnable member catcher of claim 5, wherein the body corrodes or dissolves through an electrochemical process.

7. The runnable member catcher of claim 1, wherein the body is made of controlled electrolytic metallic material.

8. The runnable member catcher of claim 1, wherein the runnable member catcher is a landing collar engagably receptive to at least one cementing wiper plug.

9. The runnable member catcher of claim 1, wherein the activation fluid is brine, acid, aqueous fluid or combinations including one or more of the foregoing.

10. A runnable member catching system comprising:

a tubular;

a body fixedly attachable within the tubular and defining a seat sealingly engagable with a member runnable thereagainst, the body being configured to be structurally weakened upon exposure to an activation fluid to facilitate removal of the body; and an insert fixedly engagable between the tubular and the body also being configured to be structurally weakened upon exposure to an activation fluid to faciliate removal of the insert.

11. The runnable member catching system of claim 10, further comprising a sleeve fixedly engagable between the tubular and the body also being configured to be structurally weakened upon exposure to an activation fluid to facilitate removal of the sleeve.

* * * * *